US011244646B1

(12) United States Patent
Lin et al.

(10) Patent No.: US 11,244,646 B1
(45) Date of Patent: Feb. 8, 2022

(54) DISPLAY DEVICE AND DISPLAY CONTROL METHOD

(71) Applicant: HIMAX TECHNOLOGIES LIMITED, Tainan (TW)

(72) Inventors: Chih-Ying Lin, Tainan (TW); Ching-Lun Chen, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 17/022,133

(22) Filed: Sep. 16, 2020

(51) Int. Cl.
*G09G 3/36* (2006.01)

(52) U.S. Cl.
CPC ... *G09G 3/3688* (2013.01); *G09G 2300/0408* (2013.01); *G09G 2310/0286* (2013.01)

(58) Field of Classification Search
CPC ..... G09G 3/3688; G09G 2300/0408; G09G 2310/0286
See application file for complete search history.

(56) References Cited

U.S. PATENT DOCUMENTS

2011/0234574 A1* 9/2011 Tanaka ..... G09G 3/2096 345/211
2015/0026506 A1* 1/2015 Lee ..... G06F 11/0751 714/3
2016/0307544 A1* 10/2016 Lin ..... G09G 5/363
2017/0132984 A1 5/2017 Dai
2019/0141357 A1* 5/2019 Endo ..... G09G 5/377
2020/0035177 A1* 1/2020 Kawachi ..... G09G 3/3677
2021/0217387 A1* 7/2021 Lim ..... G06T 5/00

FOREIGN PATENT DOCUMENTS

CN 109979372 A 7/2019
TW 201133454 A1 10/2011
TW 201839740 A 11/2018

* cited by examiner

*Primary Examiner* — Premal R Patel
(74) *Attorney, Agent, or Firm* — Winston Hsu

(57) ABSTRACT

A display device and a display control method are provided. The display device is applicable to a display panel. The display device includes a display driver integrated circuit (IC), a gate driver in panel (GIP) circuit and a GIP check circuit. The GIP circuit includes a plurality of shift registers connected in series, and the shift registers may generate a plurality of gate driving signals to control operations of a plurality of rows of display units within the display panel, respectively. The GIP check circuit may sequentially check whether a plurality of specific gate driving signals among the gate driving signals are available. The display driver IC may generate a check result according to at least one signal from the display panel, and selectively adjust display data corresponding to an image to make the display panel display an adjusted image according to the check result.

14 Claims, 12 Drawing Sheets

DISPLAY DEVICE AND DISPLAY CONTROL METHOD

BACKGROUND OF THE INVENTION

1. Field of the Invention

The present invention is related to display control, and more particularly, to a display device and a display control method applicable to the display device.

2. Description of the Prior Art

Liquid crystal display (LCD) panels are popular in various applications such as automotive display panels. A conventional display driver integrated circuit (IC) has no specific solution to deal with the problem of gate driving mechanism malfunction of a display panel, and may therefore introduce some traffic risks. In some situations, the display panel is not completely damaged, for example, a portion of might still work. Thus, there is a need for a novel method and architecture, to properly utilize the portion of gate driving mechanism that is not damaged for improving safety of an automobile driver.

SUMMARY OF THE INVENTION

This in mind, an objective of the present invention is to provide a display device and a display control method applicable to the display device, which can utilize the portion of gate driving mechanism that is not damaged as much as possible, in order to improve safety of a driver and passenger(s) on an automobile.

At least one embodiment of the present invention provides a display device, where the display device is applicable to a display panel configured to display an image. The display device may comprise a display panel and a display driver integrated circuit (IC) coupled to the display panel. The display device may further comprise a gate driver in panel (GIP) circuit and a GIP check circuit, where the GIP circuit is coupled to the display panel, and the GIP check circuit is coupled to the GIP circuit. The GIP circuit may comprise a plurality of shift registers connected in series, and the shift registers are configured to generate a plurality of gate driving signals to control operations of a plurality of rows of display units within a display active area of the display panel, respectively. The GIP check circuit may be configured to sequentially check whether a plurality of specific gate driving signals among the gate driving signals are available, and accordingly generate a check signal. The display driver IC may be configured to generate a check result according to the check signal or at least one of the gate driving signals, and selectively adjust display data corresponding to the image to make the display panel display an adjusted image in an available area of the display active area according to the check result.

At least one embodiment of the present invention provides a display control method, where the display control method is applicable to a display device. The method may comprise: utilizing a plurality of shift registers connected in series within a GIP circuit of the display device to generate a plurality of gate driving signals, respectively, wherein the gate driving signals are configured to control operations of a plurality of rows of display units within a display active area of the display panel, respectively; utilizing a GIP check circuit of the display device to sequentially check whether a plurality of specific gate driving signals among the gate driving signals are available, and accordingly generating a check signal; utilizing a display driver IC of the display device to generate a check result according to the check signal or at least one of the gate driving signals, and selectively adjusting display data corresponding to an image to make the display panel display an adjusted image in an available area of the display active area according to the check result.

The display device and the display control method provided by embodiments of the present invention can roughly determine damage condition of a display panel of the display device, and accordingly adjust display data corresponding to an image in order to utilize an available area of the display panel as much as possible when the display panel is partially damaged. Thus, the present invention can enhance safety of a driver and passenger(s) on the automobile without introducing any side effects or in a way that is less likely to introduce side effects.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
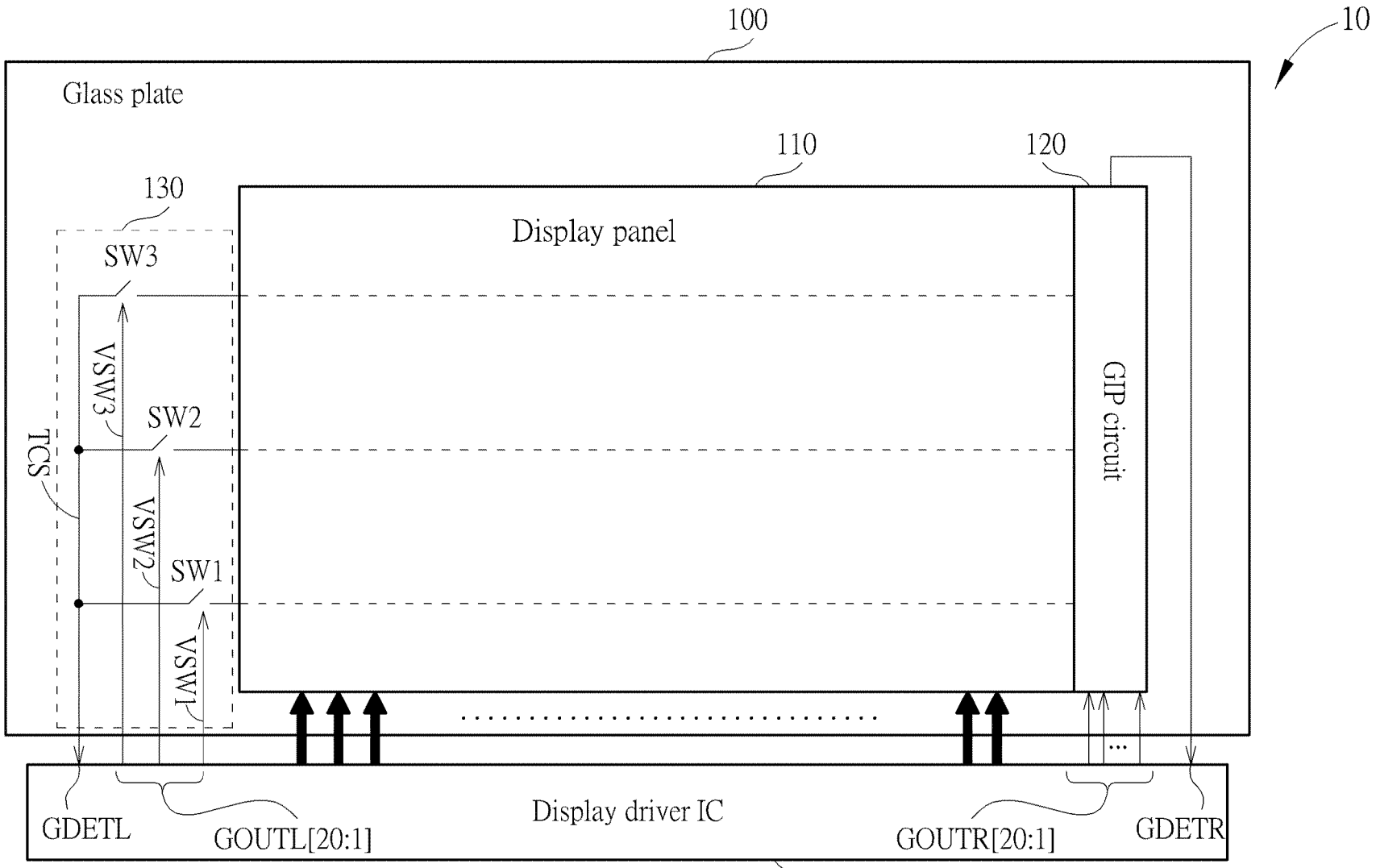
FIG. 1 is a diagram illustrating a display device according to an embodiment of the present invention.

FIG. 1 is a diagram illustrating a display device 10 according to an embodiment of the present invention. The display device 10 is applicable to a display panel (e.g. a display panel 110 shown in FIG. 1) of a dashboard of an automobile, which may display an image showing driving status (e.g. speed, oil volume, etc.) and some safety instructions, but the present invention is not limited thereto. The display device 10 may comprises a display driver integrated circuit (IC) 200, where the display driver IC 200 is coupled to the display panel 110. The display device 10 may further comprise a gate driver in panel (GIP) circuit 120 and a GIP check circuit 130, where the display panel 110, the GIP circuit 120 and the GIP check circuit 130 may be manufactured by a same process such as a Thin-Film Transistor (TFT) process, more particularly, may be built on a glass plate 100. In some embodiments, the display panel 110 is not comprised in the display device 10; in other embodiments, the display device 10 may comprise the display panel 110; but the present invention is not limited thereto. As shown in FIG. 1, the GIP circuit 120 is coupled to the display panel 110, and the GIP check circuit 130 is coupled to the GIP circuit 120. In this embodiment, the display driver IC 200 may output display data corresponding to an image (which may comprise information related to the aforementioned driving status and safety instructions) to the display panel 110 (more particularly, to a display active area of the display panel 110), and the display panel 110 (more particularly, the display active area of the display panel 110) may display the image accordingly. The image without any adjustment is referred to as an image ORG for better comprehension.

Figure 2:
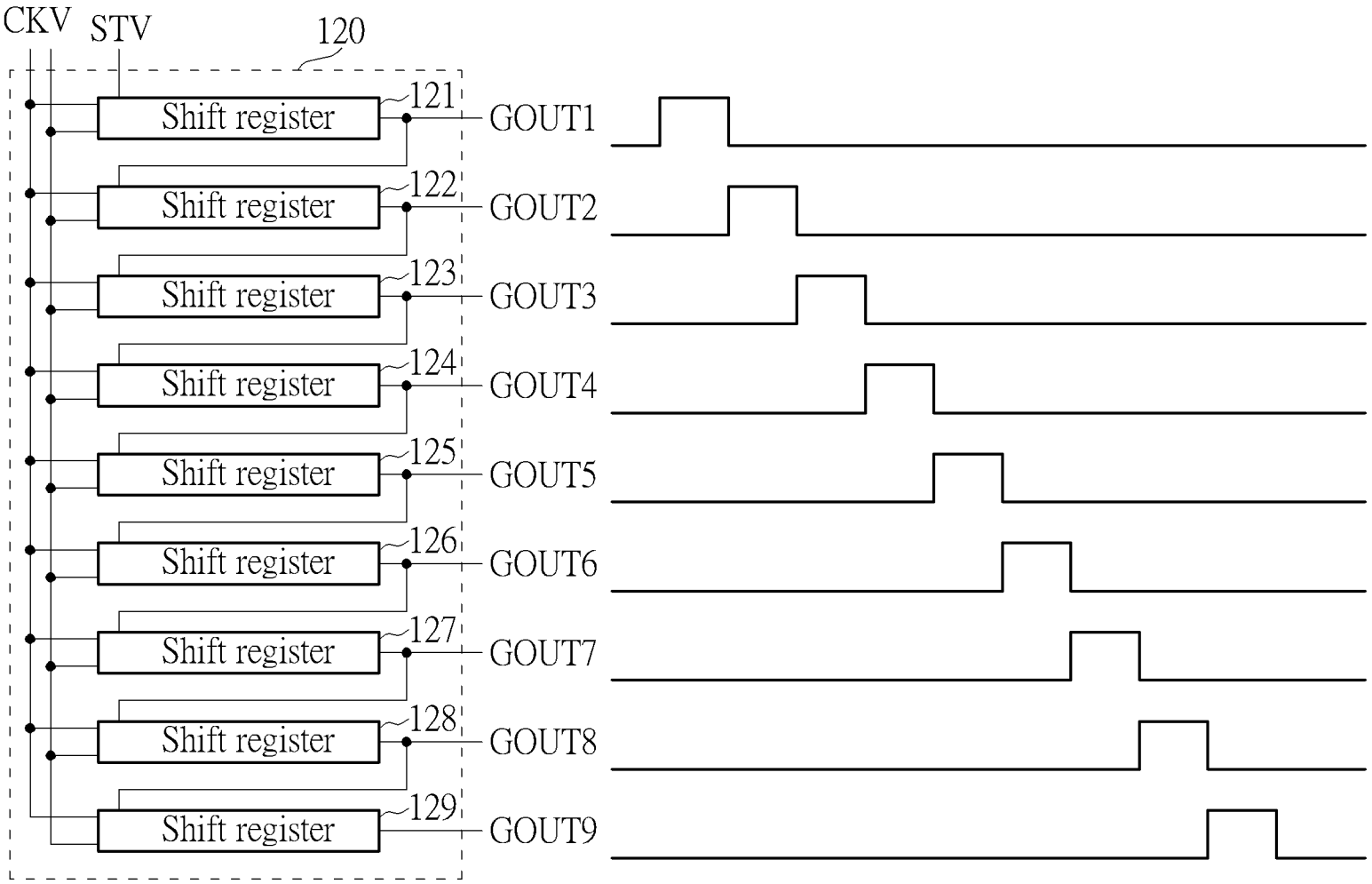
FIG. 2 is a diagram illustrating a gate driver in panel (GIP) circuit according to an embodiment of the present invention.

FIG. 2 is a diagram illustrating the GIP circuit 120 according to an embodiment of the present invention. As shown in FIG. 2, the GIP circuit 120 may comprise a plurality of shift registers (e.g. flip-flops) connected in series, such as shift registers 121, 122, 123, 124, 125, 126, 127, 128 and 129, and the shift registers may generate a plurality of gate driving signals to control operations of a plurality of rows of display units within the display active area of the display panel 110 shown in FIG. 1, respectively. In particular, each of the shift registers 121, 122, 123, 124, 125, 126, 127, 128 and 129 may be synchronized with a clock signal CKV (e.g. a pair of clock signals with opposite logic levels respectively). For example, the shift register 121 may be triggered by a start pulse signal STV and thereby generate a high pulse on a gate driving signal (e.g. an output signal GOUT1) among the gate driving signals; the shift register 122 may be triggered by the output signal GOUT1 and thereby generate a high pulse on a gate driving signal (e.g. an output signal GOUT2) among the gate driving signals; the shift register 123 may be triggered by the output signal GOUT2 and thereby generate a high pulse on a gate driving signal (e.g. an output signal GOUT3) among the gate driving signals; the shift register 124 may be triggered by the output signal GOUT3 and thereby generate a high pulse on a gate driving signal (e.g. an output signal GOUT4) among the gate driving signals; the shift register 125 may be triggered by the output signal GOUT4 and thereby generate a high pulse on a gate driving signal (e.g. an output signal GOUT5) among the gate driving signals; the shift register 126 may be triggered by the output signal GOUT5 and thereby generate a high pulse on a gate driving signal (e.g. an output signal GOUT6) among the gate driving signals; the shift register 127 may be triggered by the output signal GOUT6 and thereby generate a high pulse on a gate driving signal (e.g. an output signal GOUT7) among the gate driving signals; the shift register 128 may be triggered by the output signal GOUT7 and thereby generate a high pulse on a gate driving signal (e.g. an output signal GOUT8) among the gate driving signals; and the shift register 129 may be triggered by the output signal GOUT8 and thereby generate a high pulse on a gate driving signal (e.g. an output signal GOUT9) among the gate driving signals. As shown in FIG. 2, the output signals GOUT1, GOUT2, GOUT3, GOUT4, GOUT5, GOUT6, GOUT7, GOUT8 and GOUT9 may sequentially have a high pulse (e.g. a pulse with logic value "1") which is shifted stage by stage as shown in FIG. 2, in order to sequentially enable respective rows of display units within the display panel 110. It should be noted that the number of shift registers shown in FIG. 2 is for illustrative purpose only, and is not a limitation of the present invention. For example, the number of shift registers may be determined according to display resolution of the display panel 110, and operations of a GIP circuit with a different number of shift registers may be deduced by analogy.

Figure 3:
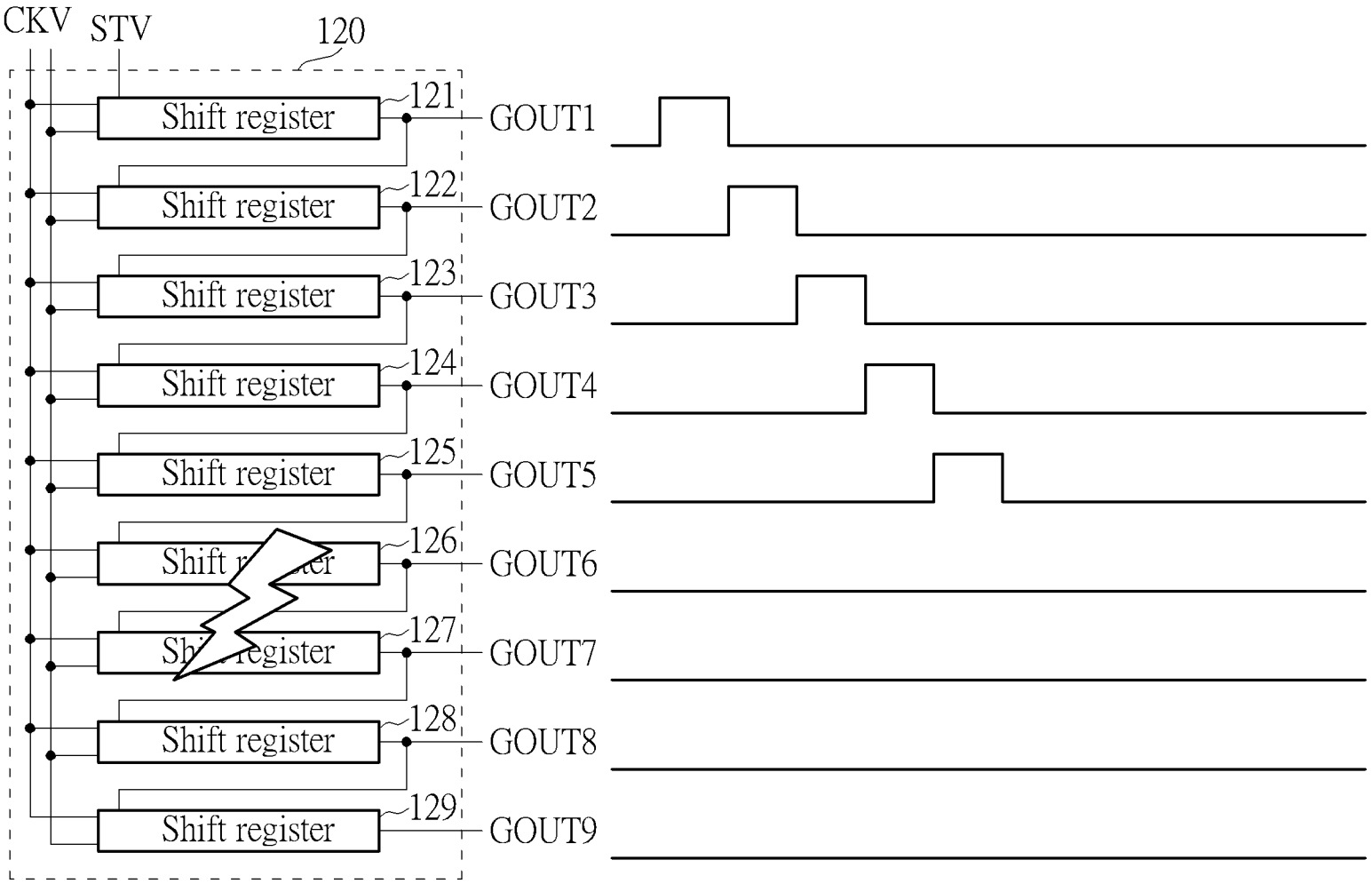
FIG. 3 illustrates a condition where one or more shift registers within the GIP circuit shown in FIG. 2 are damaged.

FIG. 3 illustrates a condition where one or more shift registers within the GIP circuit 120 shown in FIG. 2 are damaged. As shown in FIG. 3, when the shift registers 126 and 127 are damaged, the shifting operation of the high pulse is stopped at the damaged shift register such as the shift register 126, and the output signals GOUT6, GOUT7, GOUT8 and GOUT9 is therefore unavailable even though the shift registers 128 and 129 are not damaged. The shift registers 121, 122, 123, 124 and 125 still work, however. Under this condition, a portion of the display active area of the display panel 110 is unavailable, but another portion of the display active area of the display panel 110 might be still available. The display device 10 shown in FIG. 1 can enable an associated mechanism to utilize the available portion of the display active area as much as possible, in order to allow a user to at least obtain certain information (e.g. information related to the aforementioned safety instructions), and thereby guarantee safety of the driver and any other passenger of the automobile.

In this embodiment, the display active area of the display panel 110 may be divided into partitions by connecting output terminals of a plurality of specific shift registers among the shift registers (e.g. some of the shift registers 121 to 129 as shown in FIG. 2) to the GIP check circuit 130. The GIP check circuit 130 shown in FIG. 1 may sequentially check whether a plurality of specific gate driving signals among the gate driving signals generated are available, and accordingly generate a check signal VTCS. For example, the specific gate driving signals may be a plurality of predetermined gate driving signals among the plurality of gate driving signals, such as some gate driving signals of some predetermined shift registers among the plurality of shift registers, where the predetermined shift registers may be selected in advance in a design or production phase according to a predetermined rule, but the present invention is not limited thereto. As shown in FIG. 1, the GIP check circuit 130 may comprise a check signal terminal such as a terminal TCS coupled to the display driver IC 200 (e.g. a terminal GDETL of the display driver IC 200) to transmit the check signal VTCS to the display driver IC 200, and may further comprise a plurality of switches such as switches SW1, SW2 and SW3, where the switches SW1, SW2 and SW3 may be coupled between the terminal TCS and the specific shift registers. For example, the switch SW1 may be coupled between the terminal TCS and an output terminal (which outputting the signal GOUT3) of the shift register 123, the switch SW2 may be coupled between the terminal TCS and an output terminal (which outputting the signal GOUT5) of the shift register 125, and the switch SW3 may be coupled between the terminal TCS and an output terminal (which outputting the signal GOUT7) of the shift register 127, where the shift registers 123, 125 and 127 may represents the specific shift registers, but the present invention is not limited thereto. In addition, an output terminal of a last shift register that is farthest from the display driver IC 200 along an associated input signal path of the last shift register among the shift registers (e.g. the shift register 129 among the shift registers 121 to 129) may be coupled to the display driver 200 (e.g. a terminal GDETL of the display driver 200). In this embodiment, the GIP circuit 120 and the GIP check circuit 130 are positioned on different sides of the display panel 110 (e.g. the GIP circuit 120 is positioned on the right side of the display panel 110 and the GIP check circuit 130 is positioned on the left side of the display panel 110 as shown in FIG. 1); and in some embodiments, the GIP circuit 120 and the GIP check circuit 130 may be positioned on a same side of the display panel 110; but the present invention is not limited thereto.

Figure 4:
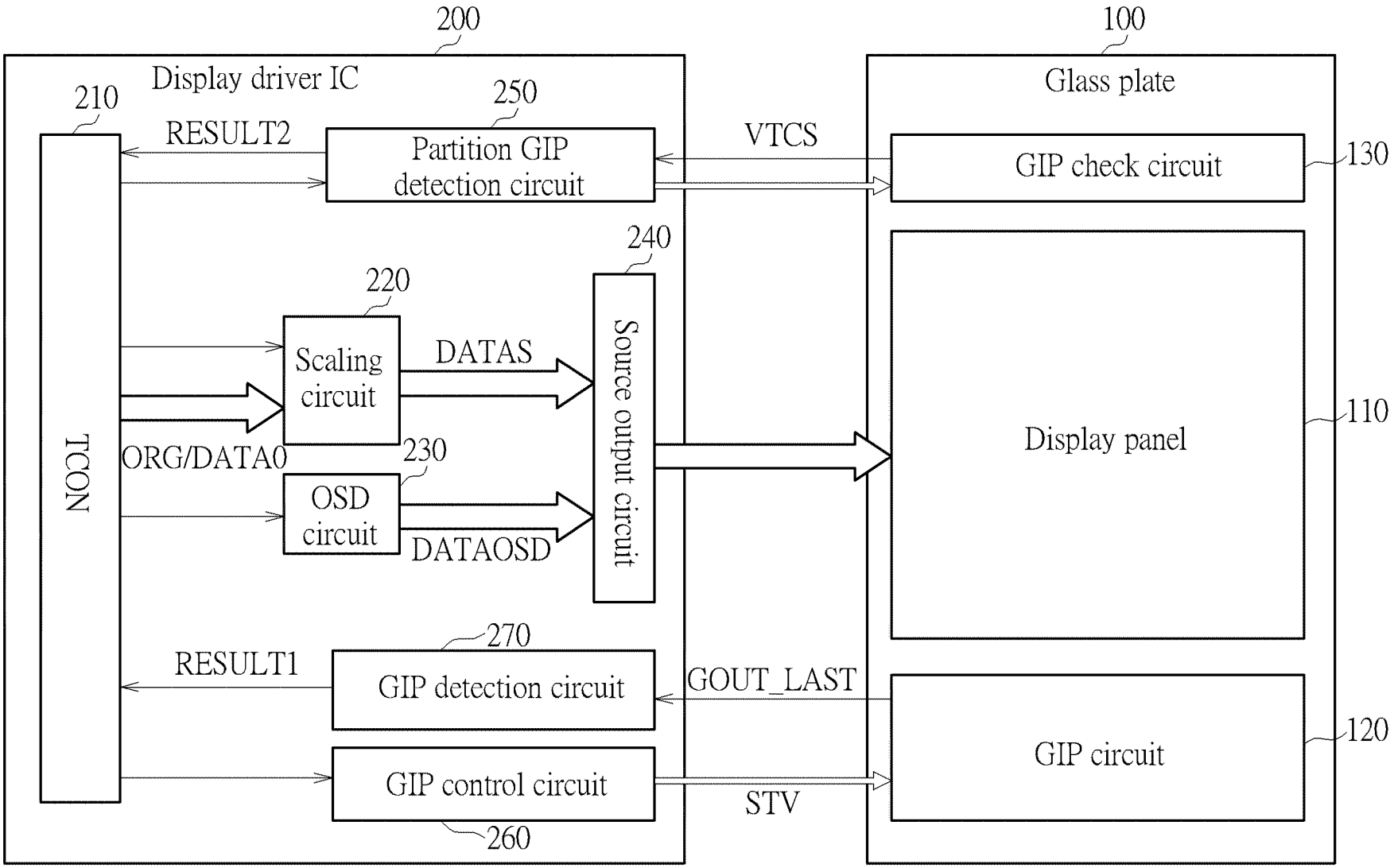
FIG. 4 is a diagram illustrating detailed implementation of the display device shown in FIG. 1 according to an embodiment of the present invention.

FIG. 4 is a diagram illustrating detailed implementation of the display device 10 shown in FIG. 1 according to an embodiment of the present invention. As shown in FIG. 4, the display driver IC 200 may comprise a timing controller (TCON) 210 and a scaling circuit 220, where the TCON 210 is configured to control operations of the display driver IC 200 (e.g. respective components within the display driver IC 200), and the scaling circuit 220 is configured to process the display data (e.g. display data DATA0) corresponding to the image ORG from the TCON 210 to generate adjusted display data (e.g. display data DATAS) when needed. In addition, the display driver IC 200 may further comprise an on-screen display (OSD) circuit 230, a source output circuit 240, a partition GIP detection circuit 250, a GIP control circuit 260 and a GIP detection circuit 270. In this embodiment, the scaling circuit 220, the OSD circuit 230, the partition GIP detection circuit 250, the GIP control circuit 260 and the GIP detection circuit 270 are coupled to the TCON 210, and the source output circuit 240 is coupled to the scaling circuit 220 and the OSD circuit 230.

In this embodiment, the GIP control circuit 260 of the display driver IC 200 may transmit a start pulse such as a high pulse of the start pulse signal STV through at least one portion of terminals GOUTR[20:1] of the display driver IC, to trigger a first shift register (e.g. the shift register 121 shown in FIG. 2) that is nearest to the display driver IC 200 along the serial connection path (e.g. the associated input signal path of the last shift register) among the shift registers within the GIP circuit 120 of the display device 10, and the output terminal of the last shift register (referred to as the shift register 12X_LAST hereinafter) that is farthest from the display driver IC 200 along the associated input signal path of the last shift register among the shift registers within the GIP circuit 120 of the display device 10 is coupled to the GIP detection circuit 270 of the display driver IC 200 through the terminal GDETR shown in FIG. 1. In this embodiment, the GIP detection circuit 270 may generate a preliminary result RESULT1 according to an output signal GOUT_LAST from the shift register 12X_LAST (e.g. check whether the output signal GOUT_LAST has the aforementioned high pulse, to generate the preliminary result RESULT1). For example, when the preliminary result indicates that the output signal GOUT_LAST is available, it means all shift registers within the GIP circuit 120 operate normally, the display driver IC 200 may prevent adjusting the display data and control the source output circuit 240 to output the display data to the display active area of the display panel 110 directly, to make the display panel 110 display the image ORG without adjustment. In another example, when the preliminary result indicates that the output signal GOUT_LAST is unavailable, it means at least one shift register within the GIP circuit 120 operates abnormally (e.g. being damaged), the display driver IC 200 may enable a detection flow to roughly find out which register (or which partial structure circuit in the display active area of the display panel 110, such as a gate line electrically connected to the output of a certain switch) is damaged, in order to determine which partition of the display active area of the display panel 110 is still available.

Figure 5:
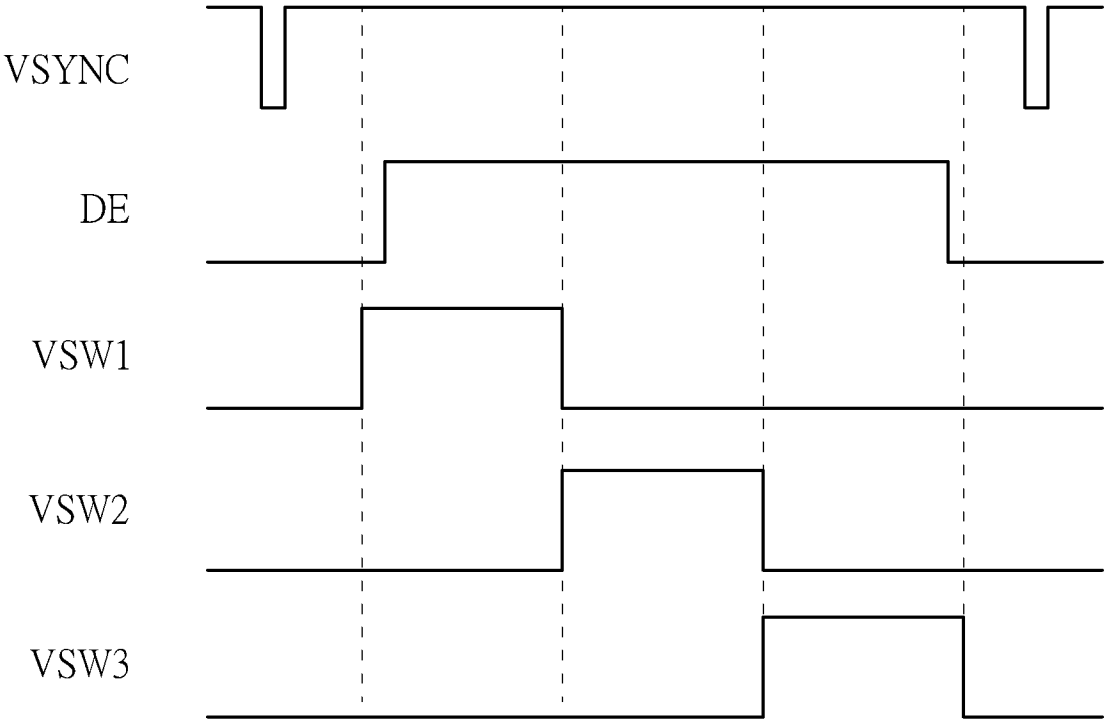
FIG. 5 is a timing diagram illustrating some signals related to a detection flow according to an embodiment of the present invention.

In this embodiment, the TCON 210 may control the partition GIP detection circuit 250 to output signals VSW1, VSW2 and VSW3 through at least one portion of terminals GOUTL[20:1] of the display driver IC 200 for respectively controlling the switches SW1, SW2 and SW3 shown in FIG. 1, respectively. FIG. 5 is a timing diagram illustrating some signals (e.g. signals VSYNC, DE, VSW1, VSW2 and VSW3) related to the detection flow according to an embodiment of the present invention, where the signal VSYNC is utilized for synchronization of the signals DE, VSW1, VSW2 and VSW3, and a high level (e.g. the logic value "1") of the signal DE means the detection flow is enabled. For example, the signal VSYNC may be a vertical synchronization signal for performing vertical synchronization of the display panel 110, where one vertical synchronization period of the vertical synchronization signal comprises three enablement periods respectively belonging to the signals VSW1, VSW2 and VSW3, and an enablement period of the signal DE starts from the enablement period of the signal VSW1 and ends at the enablement period of the signal VSW3, but the present invention is not limited thereto. For better comprehension, please refer to FIG. 5 in conjunction with FIG. 1, and take the GIP circuit 120 having the shift registers 121 to 129 shown in FIG. 2 as an example. Assume that the switch SW1 is coupled between the terminal TCS and the output terminal of the shift register 123, the switch SW2 is coupled between the terminal TCS and the output terminal of the shift register 125, and the switch SW3 is be coupled between the terminal TCS and the output terminal of the shift register 127. The GIP check circuit 130 may generate the check signal VTCS on the check signal terminal TCS by sequentially transmitting the output signals GOUT3, GOUT5 and GOUT 7 during periods of turning on the switches SW1, SW2 and SW3, respectively, and the partition GIP detection circuit 250 may generate a final result RESULT2 according to the check signal VTCS (e.g. check whether each of the output signals GOUT3, GOUT5 and GOUT7 has the aforementioned high pulse, to generate the final result RESULT2). For example, when the final result RESULT2 indicates that the output signals GOUT3, GOUT5 and GOUT7 are available, it means at least the shift registers 121 to 127 are not damaged, and therefore rows of display units controlled by the shift registers 121 to 127 are still available even though at least one of the shift registers 128 and 129 is damaged. In another example, when the final result RESULT2 indicates that the output signals GOUT3 and GOUT5 are available and the output signal GOUT7 is unavailable, it means at least the shift registers 121 to 125 are not damaged, and therefore rows of display units controlled by the shift registers 121 to 125 are still available even though at least one of the shift registers 126 and 127 is damaged. In yet another example, when the final result RESULT2 indicates that the output signal GOUT3 is available and the output signals GOUT 5 and GOUT7 are unavailable, it means at least the shift registers 121 to 123 are not damaged, and therefore rows of display units controlled by the shift registers 121 to 123 are still available even though at least one of the shift registers 124 and 125 is damaged. In yet another example, when the final result RESULT2 indicates that the output signals GOUT3, GOUT 5 and GOUT7 are unavailable, it means at least one of the shift registers 121 to 123 is damaged, and the display device 10 (e.g. the shift registers 121 to 123 therein) is too damaged to allow the display panel 110 to completely shows information included in the image ORG.

As mentioned above, the TCON 210 can determine which partition of the display active area of the display panel 110 is still available according to a check result (e.g. the preliminary result RESULT1 and/or the final result RESULT2), and the TCON 210 may accordingly control the source output circuit 240 to transmit corresponding display data to make the display panel 110 display a corresponding image which includes as much information of the image ORG as possible in an available area of the display active area of the display panel 110. In this embodiment, the available area may represents an area that is capable of displaying the corresponding image. In particularly, the display driver IC 200 may to generate a check result (e.g. the preliminary result RESULT1 and/or the final result RESULT2) according to the check signal VTCS or the output signal GOUT_LAST, and selectively adjust the display data corresponding to the image ORG to make the display panel 110 display an adjusted image in the available area of the display active area of the display panel 110 according to the check result.

Figure 6:
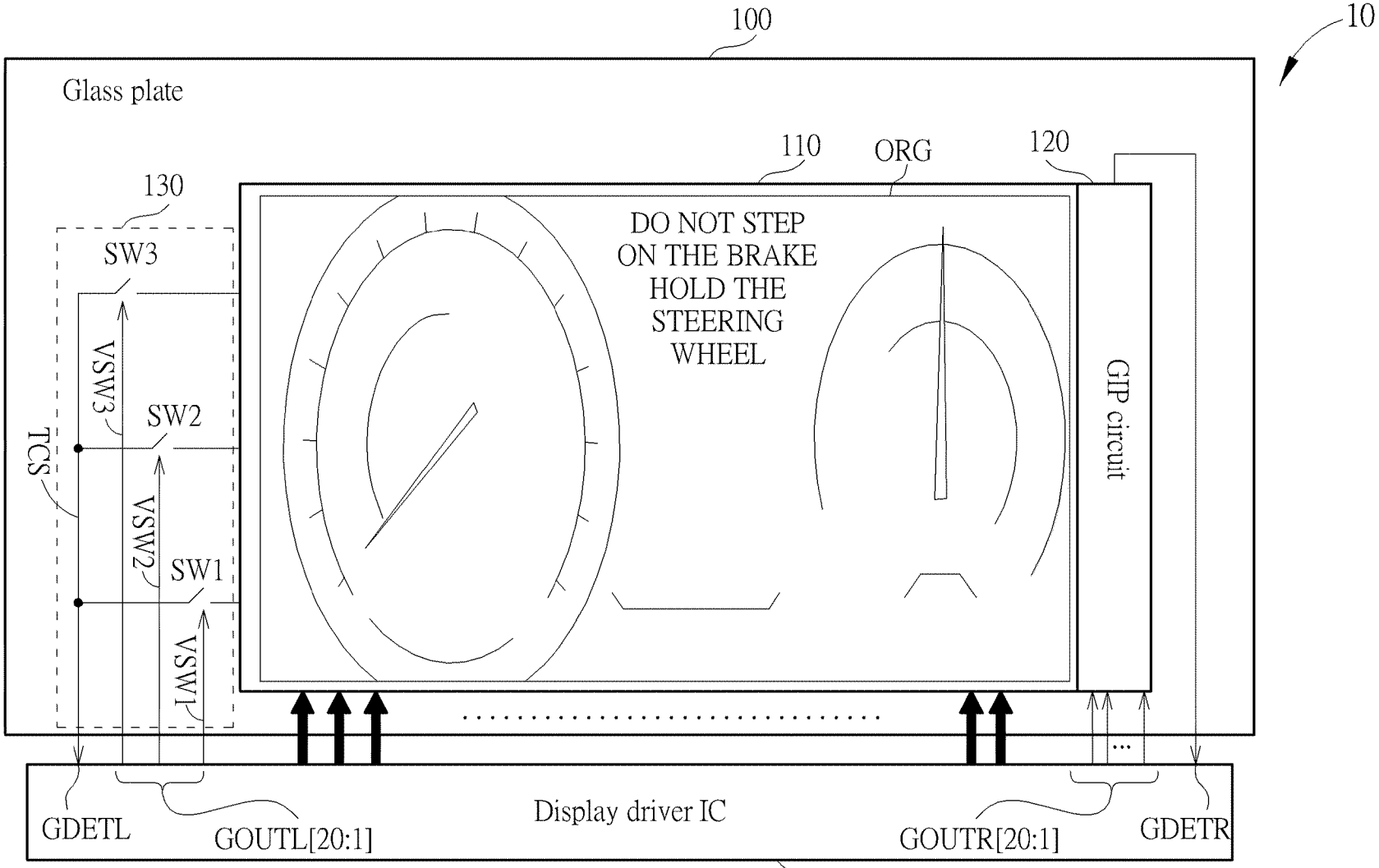
FIG. 6 illustrates the display device shown in FIG. 1 applied to an automobile display panel according to an embodiment of the present invention.

FIG. 6 illustrates the display device 10 shown in FIG. 1 applied to an automobile display panel according to an embodiment of the present invention. As mentioned above, when the preliminary result RESULT1 indicates that the output signal GOUT_LAST is available, the display driver IC 200 may prevent adjusting the display data, to make the display panel display the image ORG without adjustment.

Figure 7:
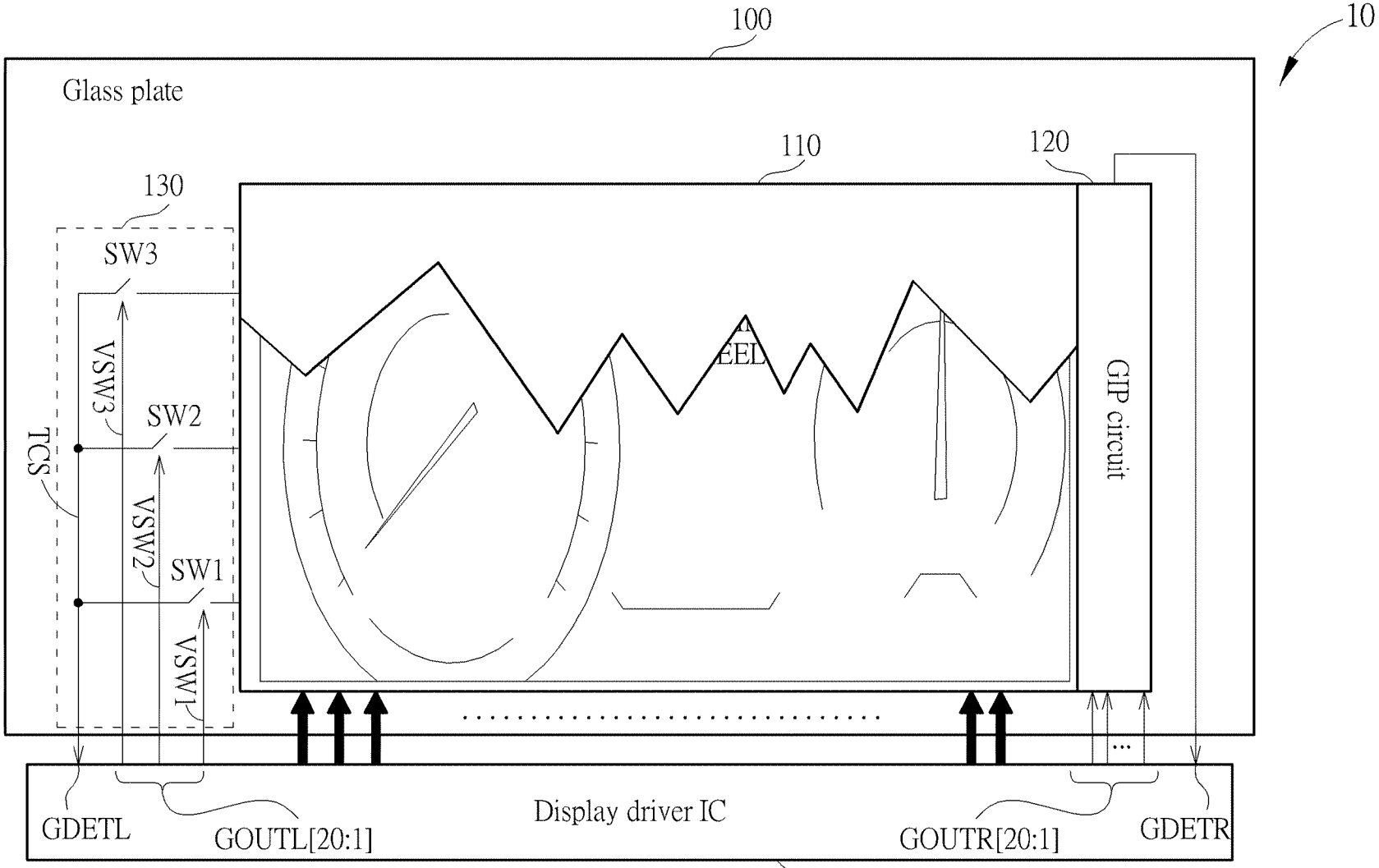
FIG. 7 illustrates a control scheme of the display device shown in FIG. 1 according to an embodiment of the present invention.

FIG. 7 illustrates a control scheme of the display device 10 shown in FIG. 1 according to an embodiment of the present invention, where display control associated with the detection flow is disabled. When the GIP circuit 120 of the display device 10 partially malfunctions, the preliminary result RESULT1 may indicate that the output signal GOUT_LAST is unavailable. As the display control associated with the detection flow is disabled, a driver of the automobile may miss certain information such as messages "DO NOT STEP ON THE BRAKE", "HOLD THE STEERING WHEEL" of the image ORG as shown in FIG. 7, and may impact the driving safety.

Figure 8:
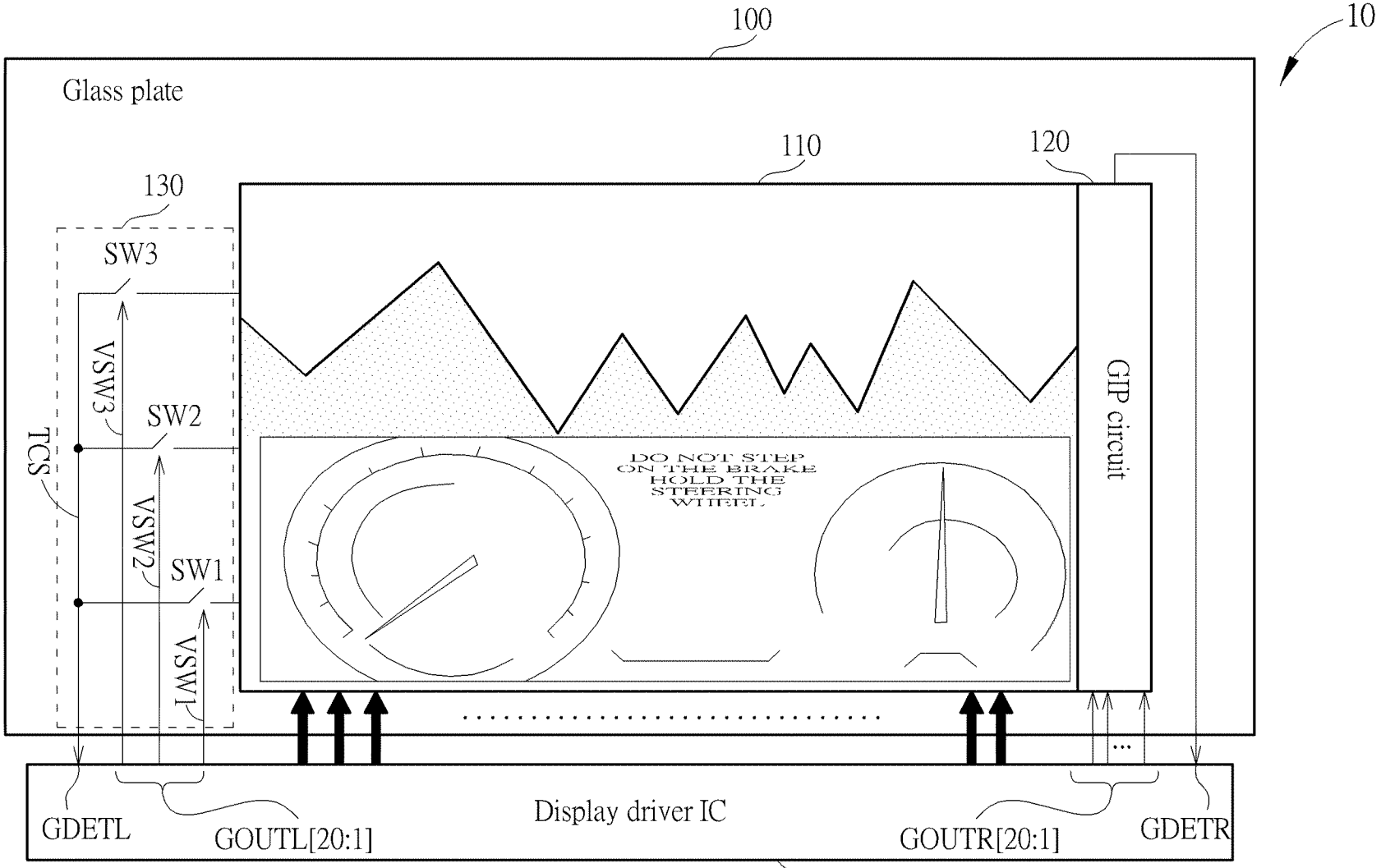
FIG. 8 illustrates a control scheme of the display device shown in FIG. 1 according to another embodiment of the present invention.

FIG. 8 illustrates a control scheme of the display device 10 shown in FIG. 1 according to another embodiment of the present invention, where the display control associated with the detection flow is enabled. When the GIP circuit 120 of the display device 10 partially malfunctions, the preliminary result RESULT1 may indicate that the output signal GOUT_LAST is unavailable. The display driver IC 200 may adjust the display data to make the display panel 110 display the adjusted image in the available area of the display active area of the display panel 110 according to the check result (e.g. the preliminary result RESULT1 and the final result RESULT2), wherein the available area is smaller than the display panel (e.g. the display active area of the display panel 110) in this control scheme. In particular, when the check result (e.g. the preliminary result RESULT1 and the final result RESULT2) indicates that a portion of the specific gate driving signals are available and the rest are unavailable (e.g. the gate driving signals transmitted from the shift registers coupled to the switches SW1 and SW2 are available and the gate driving signal transmitted from the shift register coupled to the switch SW3 is unavailable), the display driver IC 200 (e.g. the source output circuit 240 therein shown in FIG. 4) may outputs the adjusted display data generated by the scaling circuit 220 shown in FIG. 4 to make the display panel 110 display a scaled version SCL of the image ORG in the available area as shown in FIG. 8. Regarding other conditions (e.g. a condition where the gate driving signals transmitted from the shift registers coupled to the switches SW1, SW2 and SW3 are available and the GOUT_LAST is unavailable, and a condition where the gate driving signal transmitted from the shift register coupled to the switch SW1 is available and the gate driving signals transmitted from the shift registers coupled to the switches SW2 and SW3 are unavailable), the available area of the display active area of the display panel 110 may be different, and the scaled version of the image ORG may vary accordingly. Those skilled in the art should understand the display control regarding these conditions according to the above descriptions, related detail similar to this embodiment is not repeated for brevity.

Figure 9:
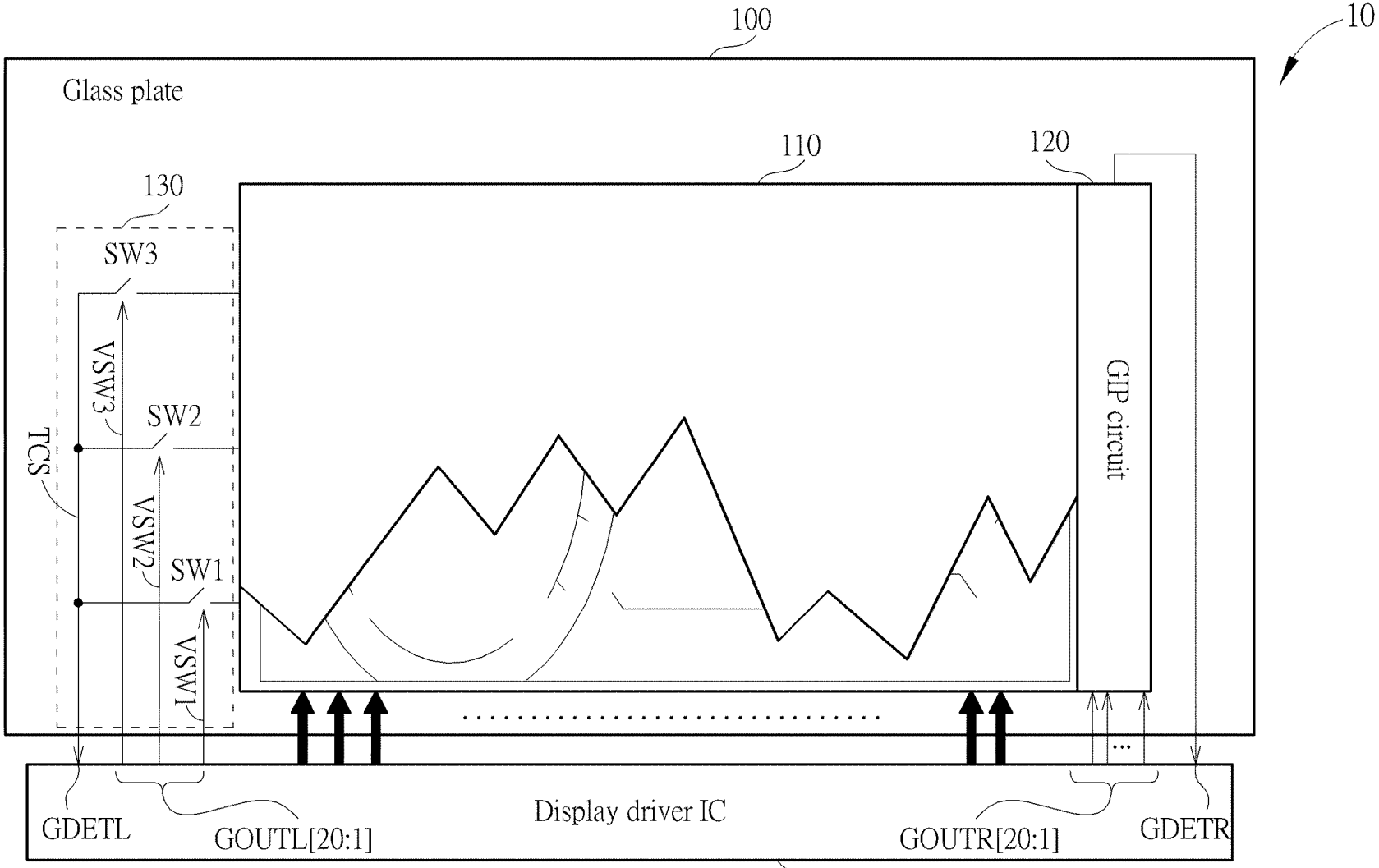
FIG. 9 illustrates a control scheme of the display device shown in FIG. 1 according to an embodiment of the present invention.
Figure 10:
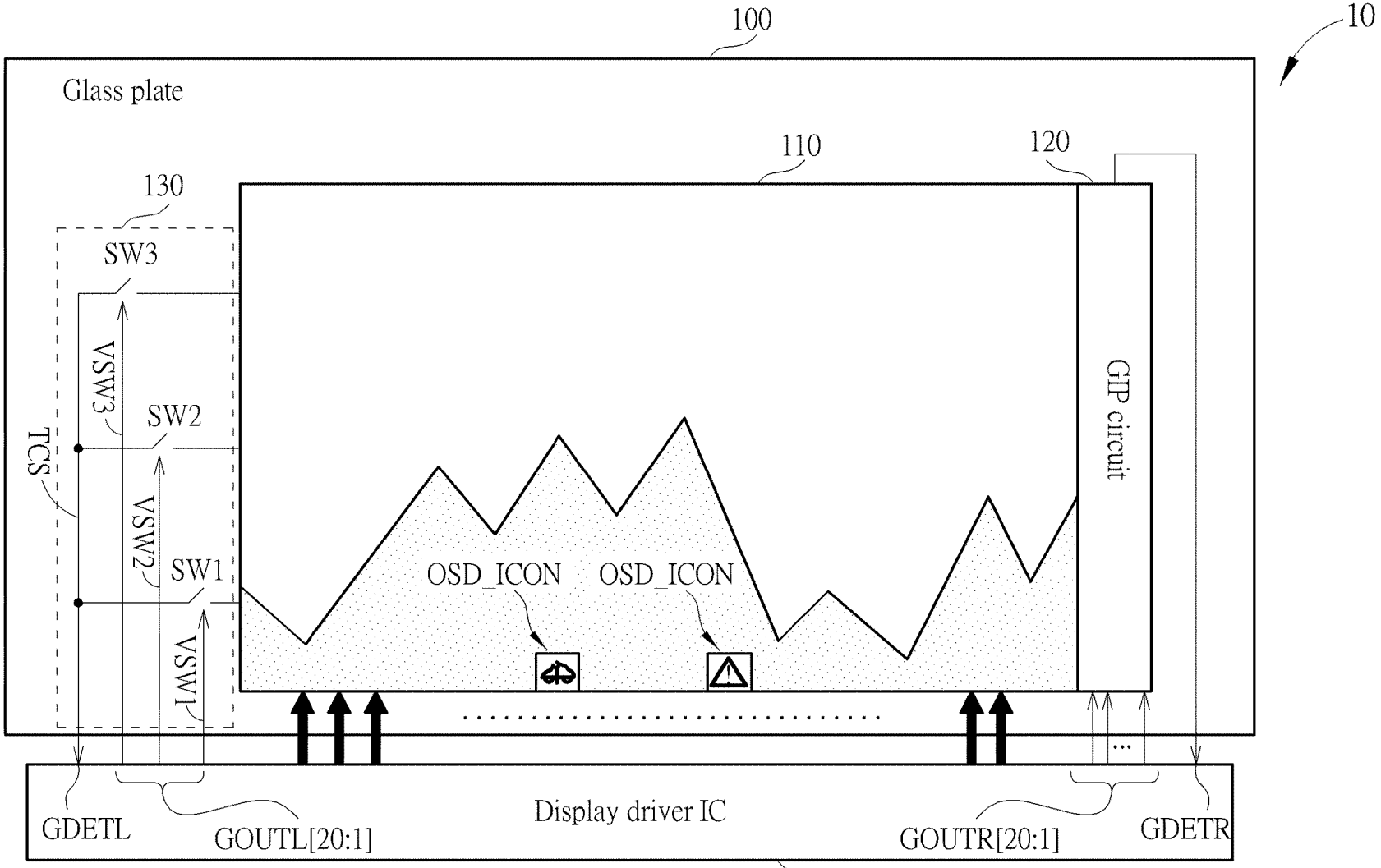
FIG. 10 illustrates a control scheme of the display device shown in FIG. 1 according to another embodiment of the present invention.

FIG. 9 illustrates a control scheme of the display device 10 shown in FIG. 1 according to an embodiment of the present invention, where the display control associated with the detection flow is disabled. As shown in FIG. 9, the GIP circuit 120 of the display device 10 severely malfunctions, and a great portion of the display active area of the display panel 110 is unavailable. FIG. 10 illustrates a control scheme of the display device 10 shown in FIG. 1 according to another embodiment of the present invention, where the display control associated with the detection flow is enabled. When the check result (e.g. the final result RESULT2) indicates that all gate driving signals transmitted from the shift registers coupled to the switches SW1, SW2 and SW3 are unavailable, the display driver IC 200 may enable a teletext OSD function and output default display data (e.g. display data DATAOSD generated by the OSD circuit 230 shown in FIG. 4) corresponding to a default image which merely shows OSD icons OSD_ICON, to make the display panel 110 display the default image in a default area, and the default area is positioned on one or more display units (e.g. one or more rows of display units) that are nearest to the display driver IC 200 along one or more associated data signal paths of the one or more display units among the plurality of rows of display units as shown in FIG. 10.

Figure 11:
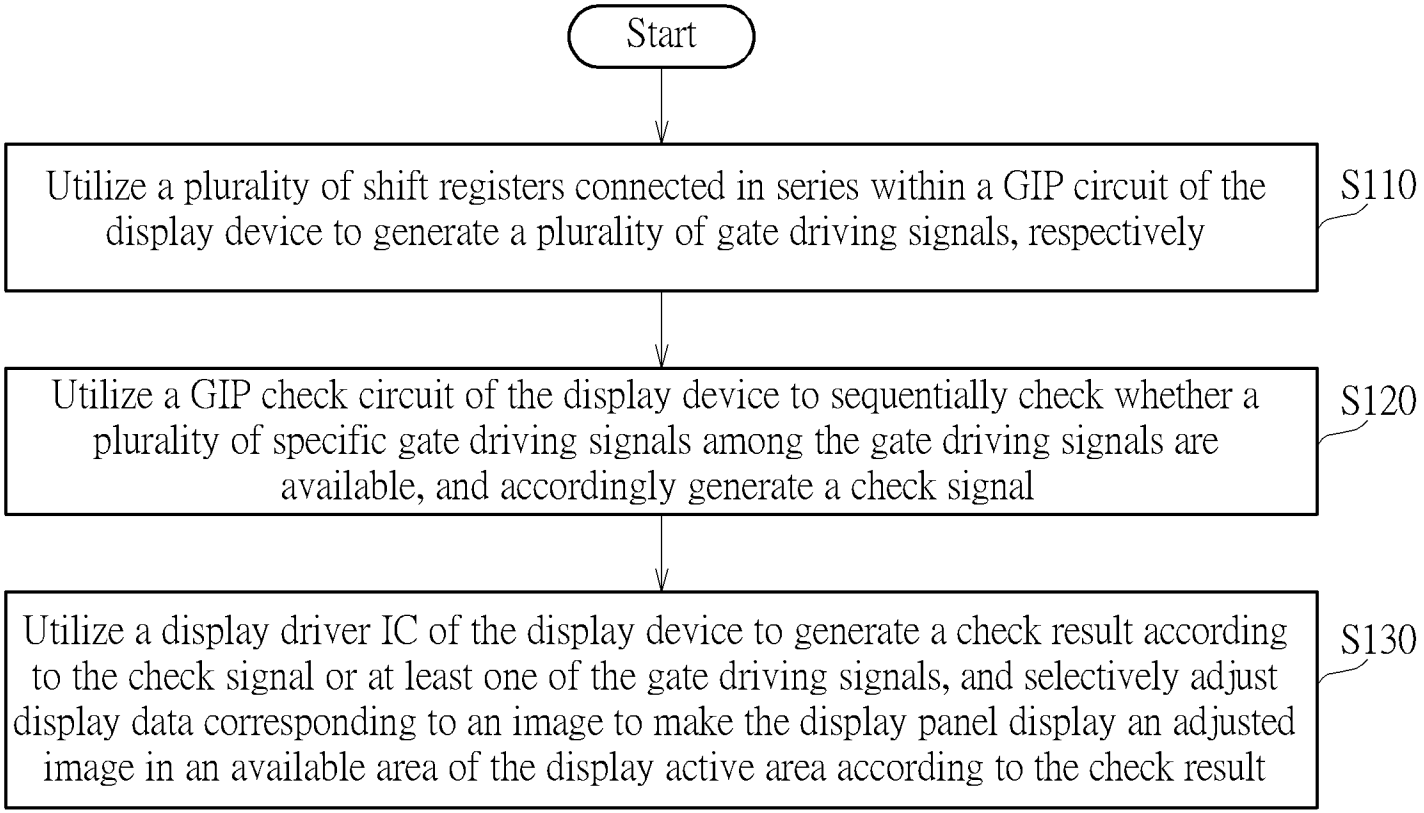
FIG. 11 is a working flow illustrating a display control method according to an embodiment of the present invention.

FIG. 11 is a working flow illustrating a display control method according to an embodiment of the present invention, where the display control method is applicable to a display device (e.g. the display device 10 shown in FIG. 1). It should be noted that the working flow shown in FIG. 11 is for illustrative purposes only, but is not a limitation of the present invention. One or more steps may be added, deleted or modified in the working flow shown in FIG. 11. In addition, if a same result may be obtained, these steps do not have to be executed in the exact order shown in FIG. 11.

In Step S110, the display device may utilize a plurality of shift registers connected in series within a GIP circuit of the display device to generate a plurality of gate driving signals, respectively, where the gate driving signals are configured to control operations of a plurality of rows of display units within a display active area of a display panel (e.g. the display device 110 shown in FIG. 1), respectively.

In Step S120, the display device may utilize a GIP check circuit of the display device to sequentially check whether a plurality of specific gate driving signals among the gate driving signals are available, and accordingly generate a check signal.

In Step S130, the display device may utilize a display driver IC of the display device to generate a check result according to the check signal or at least one of the gate driving signals, and selectively adjust display data corresponding to an image to make the display panel display an adjusted image in an available area of the display active area according to the check result.

Figure 12:
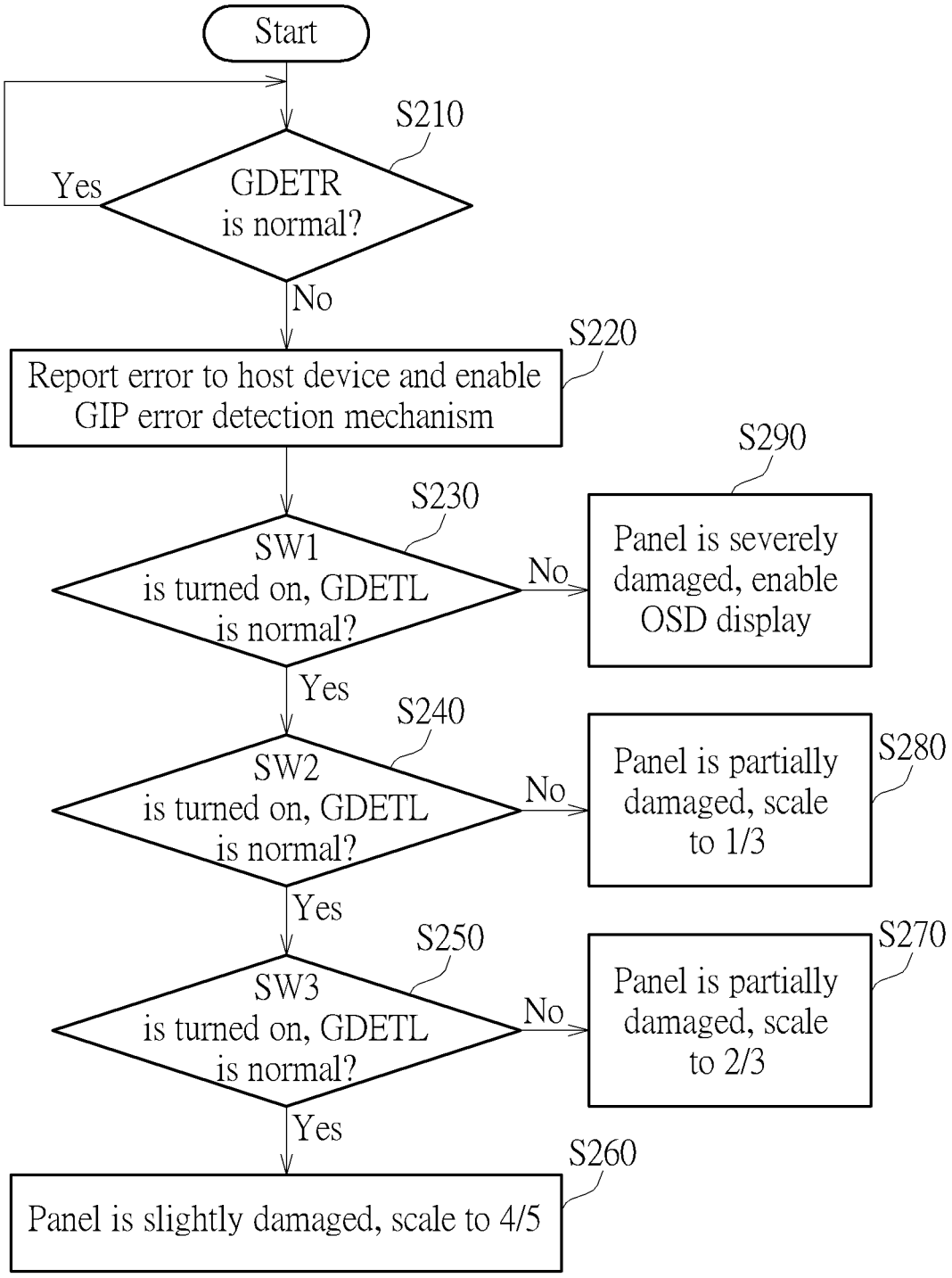
FIG. 12 illustrates detailed implementation of the working flow shown in FIG. 11 according to an embodiment of the present invention.

FIG. 12 illustrates detailed implementation of the working flow shown in FIG. 11 according to an embodiment of the present invention. For better comprehension, please refer to FIG. 12 in conjunction with FIG. 1 and FIG. 4.

In Step S210, the display device may check whether a signal (e.g. the signal GOUT_LAST) received by the terminal GDETR is normal or available (labeled "GDETR is normal?" in FIG. 12 for brevity). If the determination is "Yes", the display device normally displays the image without adjustment, and the flow returns Step S210; if the determination is "No", the flow enters Step S220.

In Step S220, the display device may report an error to a host device (e.g. the TCON 210) and enable a GIP error detection mechanism.

In Step S230, the display device may turn on the switch SW1 and check whether a signal received by the terminal GDETL is normal or available (labeled "SW1 is turned on, GDETL is normal?" in FIG. 12 for brevity). If the determination is "Yes", the flow enters Step S240; if the determination is "No", it means the display panel or the display device is severely damaged, and the flow enters Step S290.

In Step S240, the display device may turn on the switch SW2 and check whether the signal received by the terminal GDETL is normal or available (labeled "SW2 is turned on, GDETL is normal?" in FIG. 12 for brevity). If the determination is "Yes", the flow enters Step S250; if the determination is "No", it means the display panel or the display device is partially damaged, and the flow enters Step S280.

In Step S250, the display device may turn on the switch SW3 and check whether the signal received by the terminal GDETL is normal or available (labeled "SW3 is turned on, GDETL is normal?" in FIG. 12 for brevity). If the determination is "Yes", it means the display panel or the display device is slightly damaged, the flow enters Step S260; if the determination is "No", it means the display panel or the display device is partially damaged, and the flow enters Step S270.

In Step S260, the display device scales down the image by a first ratio such as four fifths and proceeds to display a scaled image as the display panel or the display device is slightly damaged (labeled "Panel is slightly damaged, scale to 4/5, proceed to display image" in FIG. 12 for brevity).

In Step S270, the display device scales down the image by a second ratio such as two thirds and proceeds to display a scaled image as the display panel or the display device is partially damaged (labeled "Panel is partially damaged, scale to 2/3, proceed to display image" in FIG. 12 for brevity).

In Step S280, the display device scales down the image by a third ratio such as one third and proceeds to display a scaled image as the display panel or the display device is partially damaged (labeled "Panel is partially damaged, scale to 1/3, proceed to display image" in FIG. 12 for brevity).

In Step S290, the display device enable OSD display as the display panel or the display device is severely damaged (labeled "Panel severely damaged, enable OSD display" in FIG. 12 for brevity).

In the above embodiments, the display driver IC 200 may generate the preliminary result RESULT1 first, and then selectively enable the GIP error detection mechanism (e.g. one or more steps of S220 to S290) according to the preliminary result RESULT1. If the preliminary result RESULT1 indicates that the display panel or the display device is not damaged at all (e.g. the determination of Step S210 is "Yes"), subsequent steps related to the GIP error detection mechanism can be omitted, but the present invention is not limited thereto.

In some embodiments, the step of generating the preliminary result RESULT1 may be omitted, and the GIP error detection mechanism may be always enabled. For example, a signal path from the shift register 12X_LAST within the GIP circuit 120 to the terminal GDETR of the display driver IC 200 shown in FIG. 1 and/or the GIP detection circuit 270 shown in FIG. 4 may be omitted. Under this configuration, the GIP check circuit 130 may further comprise another switch SWX coupled between the check signal terminal TCS and the shift register 12X_LAST, in order to check whether the whole display active area of the display panel 110 is available, but the present invention is not limited for brevity, where control method of the switch SWX is similar to that of the switches SW1, SW2 and SW3, and is not repeated here for brevity. For example, when the final result RESULT2 generated by the partition GIP detection circuit 250 shown in FIG. 4 indicates that the signal GOUT_LAST is available, the display driver IC 200 may prevent adjusting the display data, to make the display panel 110 display the image without adjustment. According to this architecture, the detailed implementation of the working flow shown in FIG. 12 may be modified; for example, Step S210 may be removed, and another step related to the SWX and the signal GOUT_LAST may be added.

Briefly summarized, the display device and the display control method provided by the embodiments of the present invention can roughly determine which partition of a display active area of the display device is surely available, and then according scaled an original image in order to display a scaled image without missing important information included in the original image. Furthermore, if the display device such as a display panel thereof is too damaged to display the scaled image, the display device may merely display OSD icons, which can notify a user (e.g. a driver of an automobile equipped with this display device) that the display panel need to be fixed. Thus, the present invention can enhance safety of a driver and passenger(s) on the automobile without introducing any side effects or in a way that is less likely to introduce side effects.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display device, applicable to a display panel configured to display an image, the display device comprising:

a gate driver in panel (GIP) circuit, coupled to the display panel, wherein the GIP circuit comprises a plurality of shift registers connected in series, and the shift registers are configured to generate a plurality of gate driving signals to control operations of a plurality of rows of display units within a display active area of the display panel, respectively;

a GIP check circuit, coupled to the GIP circuit, configured to sequentially check whether a plurality of specific gate driving signals among the gate driving signals are available, and accordingly generate a check signal; and a display driver integrated circuit (IC), coupled to the display panel, configured to generate a check result according to the check signal or at least one of the gate driving signals, and selectively adjust display data corresponding to the image to make the display panel display an adjusted image in an available area of the display active area according to the check result;

wherein the GIP check circuit comprises:

a check signal terminal, coupled to the display driver IC, configured to transmit the check signal to the display driver IC; and a plurality of switches, coupled between the check signal terminal and a plurality of specific shift registers among the shift registers, configured to transmit the specific gate driving signals from the specific shift registers to the check signal terminal.

2. The display device of claim 1, wherein the display driver IC comprises:

a GIP detection circuit, coupled to a last shift register that is farthest from the display driver IC along an associated input signal path of the last shift register among the shift registers, configured to check whether a last gate driving signal from the last shift register is available, to generate a preliminary result, wherein the at least one of the gate driving signals comprises the last gate driving signal, and the check result comprises the preliminary result.

3. The display device of claim 2, wherein when the preliminary result indicates that the last gate driving signal is available, the display driver IC prevents adjusting the display data, to make the display panel display the image without adjustment.

4. The display device of claim 2, wherein when the preliminary result indicates that the last gate driving signal is unavailable, the display driver IC adjusts the display data to make the display panel display the adjusted image in the available area of the display active area according to the check result, wherein the available area is smaller than the display active area.

5. The display device of claim 1, wherein the GIP check circuit is coupled to a last shift register that is farthest from the display driver IC along an associated input signal path of the last shift register among the shift registers; and when the check result indicates that a last gate driving signal generated by the last shift register is available, the display driver IC prevents adjusting the display data, to make the display panel display the image without adjustment, wherein the specific gate driving signals comprise the last gate driving signal.

6. The display device of claim 1, wherein the display driver IC comprises:

a timing controller, configured to control operations of the display driver IC; and a scaling circuit, configured to process the display data from the timing controller to generate adjusted display data according to the check result;

wherein when the check result indicates that a portion of the specific gate driving signals are available and the rest are unavailable, the display driver IC outputs the adjusted display data to make the display panel display a scaled version of the image in the available area, wherein the available area is smaller than the display active area.

7. The display device of claim 6, wherein the display driver IC further comprises:

an on-screen display (OSD) circuit, coupled to the timing controller, configured to generate default display data corresponding to a default image, wherein the default image merely shows one or more on-screen display (OSD) icons;

wherein when the check result indicates that all of the specific gate driving signals are unavailable, the display driver IC outputs the default display data to make the display panel display the default image in a default area, and the default area is positioned on one or more display units that are nearest to the display driver IC along one or more associated data signal paths of the one or more display units among the plurality of rows of display units.

8. A display control method, applicable to a display device, the method comprising:

utilizing a plurality of shift registers connected in series within a gate driver in panel (GIP) circuit of the display device to generate a plurality of gate driving signals, respectively, wherein the gate driving signals are configured to control operations of a plurality of rows of display units within a display active area of a display panel, respectively;

utilizing a GIP check circuit of the display device to sequentially check whether a plurality of specific gate driving signals among the gate driving signals are available, and accordingly generating a check signal;

utilizing a display driver integrated circuit (IC) of the display device to generate a check result according to the check signal or at least one of the gate driving signals, and selectively adjusting display data corresponding to an image to make the display panel display an adjusted image in an available area of the display active area according to the check result;

wherein the GIP check circuit comprises a check signal terminal coupled to the display driver IC, and comprises a plurality of switches coupled between the check signal terminal and a plurality of specific shift registers among the shift registers; and the method further comprises:

utilizing the check signal terminal to transmit the check signal to the display driver IC; and utilizing the plurality of switches to transmit the specific gate driving signals from the specific shift registers to the check signal terminal.

9. The display control method of claim 8, wherein the display driver IC comprises a GIP detection circuit coupled to a last shift register that is farthest from the display driver IC along an associated input signal path of the last shift register among the shift registers, and the display control method further comprises:

utilizing the GIP detection circuit to check whether a last gate driving signal from the last shift register is available, to generate a preliminary result, wherein the at least one of the gate driving signals comprises the last gate driving signal, and the check result comprises the preliminary result.

10. The display control method of claim 9, wherein the step of selectively adjusting the display data corresponding to the image to make the display panel display the adjusted image in the available area of the display active area according to the check result comprises:

in response to the preliminary result indicating that the last gate driving signal is available, preventing adjusting the display data, to make the display panel display the image without adjustment.

11. The display control method of claim 9, wherein the step of selectively adjusting the display data corresponding to the image to make the display panel display the adjusted image in the available area of the display active area according to the check result comprises:

in response to the preliminary result indicating that the last gate driving signal is unavailable, adjusting the display data to make the display panel display the adjusted image in the available area of the display active area according to the check result, wherein the available area is smaller than the display active area.

12. The display control method of claim 8, wherein the GIP check circuit is coupled to a last shift register that is farthest from the display driver IC among the shift registers; and the step of selectively adjusting the display data corresponding to the image to make the display panel display the adjusted image in the available area of the display active area according to the check result comprises:

in response to the check result indicates that a last gate driving signal generated by a last shift register that is farthest from the display driver IC along an associated input signal path of the last shift register among the shift registers is available, preventing adjusting the display data, to make the display panel display the image without adjustment, wherein the specific gate driving signals comprise the last gate driving signal.

13. The display control method of claim 8, wherein the step of selectively adjusting the display data corresponding to the image to make the display panel display the adjusted image in the available area of the display active area according to the check result comprises:

in response to the check result indicating that a portion of the specific gate driving signals are available and the rest are unavailable, utilizing a scaling circuit of the display driver IC to process the display data to generate adjusted display data according to the check result, to allow the display driver IC to output the adjusted display data to make the display panel display a scaled version of the image in the available area, wherein the available area is smaller than the display active area.

14. The display control method of claim 13, wherein the step of selectively adjusting the display data corresponding to the image to make the display panel display the adjusted image in the available area of the display active area according to the check result comprises:

in response to the check result indicating that all of the specific gate driving signals are unavailable, utilizing an on-screen display (OSD) circuit of the display driver IC to generate default display data corresponding to a default image, to allow the display driver IC to output the default display data to make the display panel display the default image in a default area, wherein the default area is positioned on one or more display units that are nearest to the display driver IC along one or more associated data signal paths of the one or more display units among the plurality of rows of display units.

* * * * *